US011725499B2

(12) United States Patent
Auriol et al.

(10) Patent No.: US 11,725,499 B2
(45) Date of Patent: Aug. 15, 2023

(54) METHODS RELATING TO TOOL FACE ORIENTATION

(71) Applicant: UTI LIMITED PARTNERSHIP, Calgary (CA)

(72) Inventors: Jean Antoine Jacques Roger Auriol, Calgary (CA); Roman Jgorevich Shor, Calgary (CA)

(73) Assignee: UTI LIMITED PARTNERSHIP, Calgary (CA)

( * ) Notice: Subject to any disclaimer, the term of this patent is extended or adjusted under 35 U.S.C. 154(b) by 96 days.

(21) Appl. No.: 17/153,492

(22) Filed: Jan. 20, 2021

(65) Prior Publication Data

US 2021/0231000 A1 Jul. 29, 2021

Related U.S. Application Data

(60) Provisional application No. 62/965,734, filed on Jan. 24, 2020.

(51) Int. Cl.

| | |
|---|---|
| ***E21B 47/024*** | (2006.01) |
| ***E21B 44/02*** | (2006.01) |
| ***E21B 7/04*** | (2006.01) |

(52) U.S. Cl.
CPC ..... *E21B 47/024* (2013.01); *E21B 7/04* (2013.01); *E21B 44/02* (2013.01)

(58) Field of Classification Search
CPC ..... E21B 47/024; E21B 7/04; E21B 44/02
See application file for complete search history.

(56) References Cited

U.S. PATENT DOCUMENTS

2013/0032407 A1* 2/2013 Edbury ..... E21B 44/00 175/61
2016/0024847 A1* 1/2016 Benson ..... E21B 49/00 175/24

FOREIGN PATENT DOCUMENTS

GB 2411726 * 9/2005 ..... E21B 45/00

OTHER PUBLICATIONS

Germay, C. et al. "Multiple mode analysis of the self-excited vibrations of rotary drilling systems" Journal of Sound and Vibration 325 (2009), Elsevier. 20 Pages.
Runia, D.J. et al. "A Brief History of the Shell "Soft Torque Rotary System" and Some Recent Case Studies" SPE/IADC 163548. 2013. 10 Pages.
Stroud, D. et al. "Development of the Industry's First Slimhole Point-the-Bit Rotary Steerable System" SPE 84449. 2003. 14 Pages.
Meglio, F. D. et al. "Robust output feedback stabilization of an ODE-PDE-ODE interconnection" Automatica 119 (2020) 109059. Elsevier. 7 Pages.
Halsey, G. W. et al. "Torque Feedback Used to Cure Slip-Stick Motion" SPE 18049. 1988. 6 Pages.
Mounier, H. et al. "Tracking Control of a Vibrating String With an Interior Mass Viewed as Delay System" vol. 3. Sep. 1998. Societe de Mathematiques Appliquees et Industrielles. 7 Pages.

(Continued)

*Primary Examiner* — Dany E Akakpo
(74) *Attorney, Agent, or Firm* — Brion Raffoul

(57) ABSTRACT

Systems and methods for controlling an orientation of a tool face for a drilling rig. Multiple methods are provided that use estimated tool face orientation along with measured parameters to determine inputs to the drilling rig such that, after activation, the tool face has a desired orientation.

4 Claims, 7 Drawing Sheets

(56) References Cited

OTHER PUBLICATIONS

I. N. de Almeida Jr. et al. "A Review of Telemetry Data Transmission in Unconventional Petroleum Environments Focused on Information Density and Reliability" Journal of Software Engineering and Applications, vol. 8, 2015. Scientific Research Publishing. 8 Pages.
Clegg, J. et al. "A Paradigm in Rotary Steerable Drilling—Market Demands Drive a New Solution" SPE/IADC-194170-MS. 2019. 16 Pages.
Inyang, I. J. et al. "Directional Drilling Attitude Control With Input Disturbances and Feedback Delay" International Federation of Automatic Control. 2017. Elsevier. 6 Pages.
Wilson, J. K. et al. "Investigating the Benefits of Induced Vibrations in Unconventional Horizontals via Nonlinear Drill String Dynamics Modeling" SPE/IADC-173049-MS. 2015. 21 Pages.
Jacobs, T. "Automated Drilling Technologies Showing Promise" Journal of Petroleum Technology. Jun. 2015. 6 Pages.
Astrom, K. J. et al. "Feedback Systems: An Introduction for Scientists and Engineers" Princeton University Press. Feb. 2009. 408 Pages.
Kyllingstad, A. et al. "A New Stick-Slip Prevention System" SPE/IADC 119660. 2009. 14 Pages.
Kyllingstad, A. "A Comparison of Stick-slip Mitigation Tools" SPE/IADC-184658-MS. 2017. 16 Pages.
Ledgerwood III, L.W. et al "The Effect of Bit Type on Reactive Torque and Consequent Toolface Control Anomalies" SPE-174949-MS. 2016. 20 Pages.
Leveque, R. J. "Finite vol. methods for hyperbolic problems" 2004. Cambridge University Press.
Sheppard. M. C. et al. "Designing-Well Paths to Reduce Drag and Torque" Dec. 1987. SPE Drilling Engineering. 7 Pages.
Fliess, M. et al. "Flatness and defect of non-linear systems: introductory theory and examples" International Journal of Control. 1995. vol. 61. No. 6. 36 Pages.
Weijermans, P. et al. "Drilling with Rotary Steerable System Reduces Wellbore Tortuosity" SPE/IADC 67715. 2001. 10 Pages.
Schaaf, S. et al. "Point-the-Bit Rotary Steerable System: Theory and Field Results" SPE 63247. 2000. Society of Petroleum Engineers Inc. 9 Pages.
Dwars. S. "Recent Advances in Soft Torque Rotary Systems." SPE/IADC-173037-MS. 2015. SPE/IADC Drilling Conference and Exhibition. 12 Pages.
Aarsnes. U. J. et al. "Torsional vibrations with bit off bottom: Modeling, characterization and field data validation" Journal of Petroleum Science and Engineering 163. 2018. Elsevier. 10 Pages.
Aarsnes. U. J. et al. "Avoiding stick slip vibrations in drilling through startup trajectory design" Journal of Process Control 70. 2018. Elsevier. 12 Pages.
Aarsnes. U. J. et al. "Axial and torsional self-excited vibrations of a distributed drill-string" Journal of Sound and Vibration 444. 2019. Elsevier. 25 Pages.
Aarsnes. U. J. et al. "Linear stability analysis of self-excited vibrations in drilling using an infinite dimensional model" Journal of Sound and Vibration 360. 2016. Elsevier. 21 Pages.
Aarsnes. U. J. et al. "Benchmarking of Industrial Stick-Slip Mitigation Controllers" International Federation of Automatic Control. 2018. Elsevier. 6 Pages.
Aarsnes. U. J. et al. "Estimating friction factors while drilling" Journal of Petroleum Science and Engineering 179. 2019. Elsevier. 12 Pages.

* cited by examiner

| Controller | Requirements | Performance |
|---|---|---|
| Feed-forward control | Good model of drill string<br>Stable off-bottom rotation<br>Tool face orientation estimation | One iteration |
| Rotating iteration | Stable off-bottom rotation<br>Tool face orientation estimation | Two iterations |
| Bump iteration | Estimation of the release torque | Three iterations |

METHODS RELATING TO TOOL FACE ORIENTATION

RELATED APPLICATIONS

This application is a non-provisional patent application that claims benefit of U.S. Provisional application No. 62/965,734 filed on Jan. 24, 2020.

TECHNICAL FIELD

The present invention relates to drilling technologies. More specifically, the present invention relates to systems and methods for controlling and setting tool face orientation for borehole assemblies.

BACKGROUND

In the field of drilling, to access resources in the subsurface, a slender borehole, between 10 and 60 centimeters in diameter, must be drilled along a precise wellpath from the surface to the subsurface target. To achieve precise positional control, two general classes of methods are typically used. In the first class, an active tool is placed near the drill bit which actively deflects the drill string to achieve directional capability, such as precise wellpaths. However, these tools are often prohibitively expensive for low margin or low cost operations, are not capable of delivering high turn rates and are prone to failure but remain in development. In the second class, a bent downhole mud motor is used. By placing a 1 to 5 degree bend in the pipe above a positive displacement motor (PWM) motor, steering may be achieved by alternatively rotating the bend—for a predominantly straight borehole—or holding the bend stationary and drilling solely using the downhole motor—for the curving wellbore. For this technique, a precise angular position—the tool face—of the bend is necessary to achieve directional guidance. Today, tool face is set by a human directional driller based on experience and limited downhole data which is communicated from downhole using either mud pulse telemetry or electromagnetic communication. Both of these are of low bandwidth with high latency. Automated tool face control has been attempted, however, the long latency (1 to 20 seconds) of downhole telemetry has made automatic feedback control significantly slower than manual control. Target zones for current wells are often thin (i.e. 5 to 30 meters thick) layers of reservoir or source rock for hydrocarbons and precise placement of wells is critical for economic production of the in-situ hydrocarbon. Typical directional wells have between 50 and 150 'slides'—where tool face is kept constant—for directional guidance, and human directional drillers spend up to 10 minutes setting tool face on each slide. Tool face accuracy may be as low as ±45°, which results in highly tortuous wellbores which not only reduce drilling performance, but also future hydrocarbon production.

Based on the above, there is therefore a need for systems and methods that mitigate if not overcome the issues with previously known techniques and methods. Preferably, such methods and systems enable faster and more precise geosteering in directional drilling.

SUMMARY

The present invention provides systems and methods for controlling an orientation of a tool face for a drilling rig. Multiple methods are provided that use estimated tool face orientation along with measured parameters to determine inputs to the drilling rig such that, after activation, the tool face has a desired orientation.

In a first aspect, this document discloses a method for controlling an orientation of a drilling rig tool face, the method including: a) stabilizing an angular velocity of a borehole assembly of the drilling rig to an angular velocity reference; b) determining an estimated orientation of the tool face; c) executing either steps d) to h) or i) to n); d) determining a first trajectory that adjusts the estimated orientation of the tool face to a desired orientation; e) determining a second trajectory for an angular velocity of the borehole assembly based on the first trajectory; f) determining control inputs for the drilling rig to produce the second trajectory; g) applying the control inputs to the drilling rig to thereby produce the desired orientation; h) ending the method; i) adjusting the angular velocity reference for the drill rig by applying a function to the angular velocity reference such that the angular velocity reference smoothly reduces to zero; j) determining a new estimated orientation of the tool face, the new estimated orientation being a result of executing step i); k) restarting the borehole assembly and stabilizing the angular velocity of the borehole assembly to the angular velocity reference; l) continuing operation of the borehole assembly until an orientation of the tool face is equal to a desired orientation plus a difference between the estimated orientation and the new estimated orientation; m) applying the function to the angular velocity reference; n) repeating steps j)-n) in the event an orientation of the tool face is not equal to the desired orientation.

In a second aspect, this document discloses a method for controlling an orientation of a drilling rig tool face, the method including: a) stabilizing a velocity of a borehole assembly of the drilling rig to a velocity reference; b) prior to a motor of a top drive reaching a release torque that causes motion to the tool face, increasing an input to the top drive to cause an increase in torque in the motor, an increase in the input being of a specified value; c) determining an initial estimated difference in orientation of the tool face due to the increase in input; d) repeating steps a) and b) with the input having a value equal to an immediately preceding input value and the specified value; e) determining a second estimated difference in orientation of the tool face due to the input equalling the immediately preceding input value and the specified value; f) determining a desired input value to produce the desired orientation based at least on the initial estimated difference and the second estimated difference and the specified value; g) repeating step a) and applying the desired input value determined in step f) to produce the desired orientation of the tool face.

In a third aspect, this document discloses a method for controlling an orientation of a drilling rig tool face, the method including: a) stabilizing a velocity of a borehole assembly of the drilling rig to a velocity reference; b) determining an estimated orientation of the tool face; c) determining a first trajectory that adjusts the estimated orientation of the tool face to a desired orientation; d) determining a second trajectory for a velocity of the borehole assembly based on the first trajectory; e) determining control inputs for the drilling rig to produce the second trajectory; f) applying the control inputs to the drilling rig to thereby produce the desired orientation.

In a fourth aspect, this document discloses a method for controlling an orientation of a drilling rig tool face, the method including: a) stabilizing a velocity of a borehole assembly of the drilling rig to a velocity reference; b)

determining an estimated orientation of the tool face; c) adjusting the velocity reference for the drill rig by applying a function to the velocity reference such that the velocity reference smoothly reduces to zero; d) determining a new estimated orientation of the tool face, the new estimated orientation being a result of executing step c); e) restarting the borehole assembly and stabilizing the velocity of the borehole assembly to the velocity reference; f) continue operation of the borehole assembly until an orientation of the tool face is equal to a desired orientation plus a difference between the estimated orientation and the new estimated orientation; g) applying the function to the velocity reference; h) repeating steps d)-h) in the event an orientation of the tool face is not equal to the desired orientation.

In a fifth aspect, this document discloses a method for controlling an orientation of a drilling rig tool face, the method including: a) stabilizing a velocity of a borehole assembly of the drilling rig to a velocity reference; b) prior to a motor of a top drive reaching a release torque that causes motion to the tool face, increasing an input to the top drive to cause an increase in torque in the motor, an increase in the input being of a specified value; c) determining an initial estimated difference in orientation of the tool face due to the increase in input; d) repeating steps a) and b) with the input having a value equal to an immediately preceding input value and the specified value; e) determining a second estimated difference in orientation of the tool face due to the input equalling the immediately preceding input value and the specified value; f) determining a desired input value to produce the desired orientation based at least on the initial estimated difference and the second estimated difference and the specified value; g) repeating step a) and applying the desired input value determined in step f) to produce the desired orientation of the tool face, wherein in the event a difference between the initial estimated difference and the second estimated difference is larger than desired, decreasing the specified value and re-executing the method.

In a sixth aspect, this document discloses a method for controlling an orientation of a drilling rig tool face, the method including: a) stabilizing a velocity of a borehole assembly of the drilling rig to a velocity reference; b) prior to a motor of a top drive reaching a release torque that causes motion to the tool face, increasing an input to the top drive to cause an increase in torque in the motor, an increase in the input being of a specified value; c) determining an initial estimated difference in orientation of the tool face due to the increase in input; d) repeating steps a) and b) with the input having a value equal to an immediately preceding input value and the specified value; e) determining a second estimated difference in orientation of the tool face due to the input equalling the immediately preceding input value and the specified value; f) determining a desired input value to produce the desired orientation based at least on the initial estimated difference and the second estimated difference and the specified value; g) repeating step a) and applying the desired input value determined in step f) to produce the desired orientation of the tool face, wherein in the event a difference between an orientation of the tool face and the desired orientation is larger than a threshold, decreasing the commanded input velocity trajectory and re-executing the method.

In a seventh aspect, this document discloses a method for controlling an orientation of a drilling rig tool face, the method including: a) stabilizing a velocity of a borehole assembly of the drilling rig to a velocity reference; b) prior to a motor of a top drive reaching a release torque that causes motion to the tool face, increasing an input to the top drive to cause an increase in torque in the motor, an increase in the input being of a specified value; c) determining an initial estimated difference in orientation of the tool face due to the increase in input; d) repeating steps a) and b) with the input having a value equal to an immediately preceding input value and the specified value; e) determining a second estimated difference in orientation of the tool face due to the input equalling the immediately preceding input value and the specified value; f) determining a desired input value to produce the desired orientation based at least on the initial estimated difference and the second estimated difference and the specified value; g) repeating step a) and applying the desired input value determined in step f) to produce the desired orientation of the tool face, wherein in the event a difference between an orientation of the tool face and the desired orientation is larger than a threshold, adjusting the specified value and re-executing the method.

BRIEF DESCRIPTION OF THE DRAWINGS

The embodiments of the present invention will now be described by reference to the following figures, in which identical reference numerals in different figures indicate identical elements and in which.

DETAILED DESCRIPTION

Figure 1:
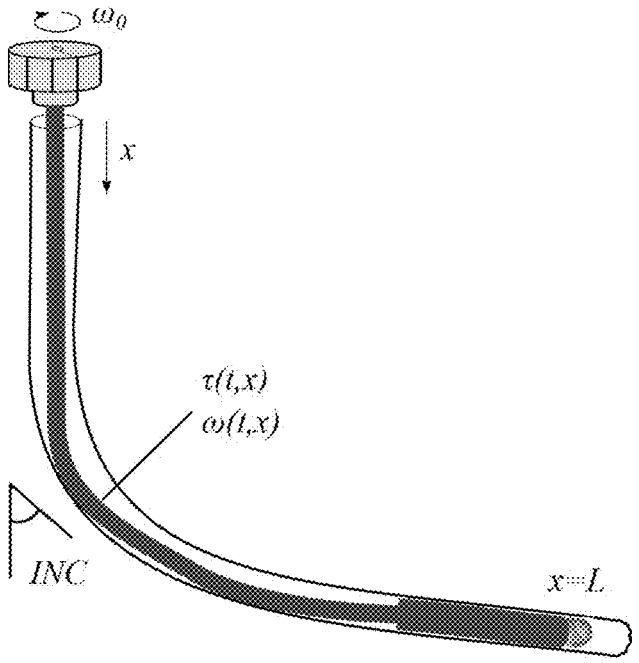
FIG. 1 is a schematic detailing a distributed drill string lying in deviate borehole.

For clarity, the following table details the symbols and variables used in this document along with what these symbols and variables represent.

TABLE 1

| Nomenclature Parameters | |
|---|---|
| $c_t$ | torsional wave velocity |
| $\mathcal{F}$ | Coulomb component of side force |
| $G, G_p, G_c$ | drill string, pipe, collar shear modulus |
| $I_{TD}$ | top drive inertia |
| $J, J_p, J_c$ | drill string, pipe, collar moment of inertia |
| $k_t$ | viscous component of side force |
| $L, L_p, L_c$ | drill string, pipe, collar length |
| $Z$ | collar-pipe relative impedance |
| $\zeta_p$ | pipe characteristic impedance |
| $\mu_k, \mu_s$ | kinetic, static friction coefficient |
| $\rho, \rho_p, \rho_c$ | drill string, pipe, collar density |
| $\omega_c$ | angular velocity threshold |

$p_\alpha(\bullet), p_\beta(\bullet), p_0, p_1, P_0, P_1, l_s$ and $l_k$ are observer gains.

TABLE 1-continued

| Nomenclature Parameters | |
|---|---|
| Dependent variables | |
| $F_N$ | normal force on drill string |
| $\theta,\sigma_e$ | angular and tension profile of the well |
| $W_b$ | buoyed weight per meter |
| S | torque source term (side force) |
| $\alpha,\beta$ | drill string Riemann invariants |
| $\omega$ | drill string angular velocity |
| $\tau$ | drill string torque |
| $\tau_m$ | motor torque |
| $\phi$ | tool face orientation |
| $\omega_0$ | Top drive angular velocity |
| $r_o$ | outer drill string radius |

The present invention involves a number of methods that achieve automatic closed loop tool face control with the drill bit (the cutting tool located at the extremity of the drill string) off bottom. These methods enable faster and more precise geosteering in directional drilling.

The present invention provides three methods to achieve reliable closed-loop, tool face control for directional drilling operations. The methods and processes of the invention combine existing industry top-drive controllers with new control approaches. The torsional model used for the drill string has been field validated and takes into account the Coulomb friction between the drill string and the borehole. These distributed friction terms are either assumed known (or measured) or can be estimated using a state-observer. The present invention also provides improvements of such a state-observer to obtain an estimation of the tool face orientation in real-time. In addition, the present invention provides different approaches to control the tool face. The first method is based on a feed-forward control law. It uses the flatness of the model and the estimation of the orientation to generate an admissible trajectory which is then tracked. In the second procedure or method, with a stable rotation off-bottom, smoothly changing the reference to zero to stop bit rotation is used. This change of reference induces a change of orientation that can be estimated and finally compensated for by repeating the procedure. Finally, the last method uses a series of trapezoidal setpoint inputs—referred to herein as bumps—to calculate the change in downhole tool face per change in surface orientation before arriving at the correct tool face after a number of iterations. These three methods or processes are illustrated in simulations of field scenarios and their effectiveness and limitations, depending on the reliability and availability of downhole orientation data, are discussed below.

Model

This section recaps the torsional drill string model, with distributed friction terms. The high fidelity—shown previously through comparisons with field data—and computational simplicity allows the model to be used in control and estimation applications. The main assumptions are as follows:

- Torsional motion is the dominant dynamic.
- Static and dynamic friction is modeled as a jump, i.e., the Stribeck curve is assumed negligible.
- The effect of along-string cuttings distribution is assumed constant and homogeneous.
- The effect of the pressure differential, inside and outside the drill string, on the bending moment is not represented and is assumed to be negligible.

Torsional Dynamics of Drill String

The torsional motion of the drill string is assumed to be the dominating dynamic behavior. The torsional dynamics is represented using a popular model (noted in the references listed at the end of this document) of a distributed wave model where discontinuities in impedance can be included to model different sections of the drill string, such as a pipe and a collar section. The reader is referred to the references below for the full model derivation.

A schematic representation of the drill string is given in FIG. 1. We denote the angular velocity and torque as $\omega(t,x),\tau(t,x)$, respectively, with $(t,x)\in[0,\infty)\times[0,L]$ (L being the length of the drill string). We have $$\frac{\partial\tau(t,x)}{\partial t}+JG\frac{\partial\omega(t,x)}{\partial x}=0 \tag{1}$$

$$J\rho\frac{\partial\omega(t,x)}{\partial t}+\frac{\partial\tau(t,x)}{\partial x}=S(t,x), \tag{2}$$

where, J is the polar moment of inertia, G the shear modulus and $\rho$ the drill string density. The source term S is modeled as $$S(t,x)=-k_t\rho J\omega(t,x)-\mathcal{F}(t,x), \tag{3}$$

In Equation (3), the damping constant $k_t$ represents the viscous shear stresses and where $\mathcal{F}(t,x)$ is a differential inclusion that represents the Coulomb friction between the drill string and the borehole, also known as the side force. This side force is modeled using the following inclusion $$\begin{cases}\mathcal{F}(t,x)=r_o(x)\mu_kF_N(x), & \omega(t)>\omega_c\\ \mathcal{F}(t,x)\in\pm r_o(x)\mu_zF_N(x), & |\omega(t)|>\omega_c\\ \mathcal{F}(t,x)=-r_o(x)\mu_kF_N(x), & \omega(t)<-\omega_c\end{cases} \tag{4}$$

In Equation (4), $\mu_s$ is the static friction coefficient (i.e. the friction between two or more solid objects that are not moving relative to each other) and $\mu_k$ kinetic friction coefficient (also known as dynamic friction or sliding friction, which occurs when two objects are moving relative to each other and rub together), $\omega_c$ is the threshold on the angular velocity where the Coulomb friction transits from static to dynamic, and $r_o(x)$ is the outer drill string radius. The function $F_N$ is the normal force acting between the drill string and the borehole wall. The function $\mathcal{F}(t,x)\in\pm r_o(x)\mu_sF_N(x)$ denotes the inclusion where $$\mathcal{F}(t,x)=-\frac{\partial\tau(t,x)}{\partial t}-k_t\rho J\omega(t,x)\in[-r_o(x)\mu_sF_N(x),\ r_o(x)\mu_sF_N(x)]. \tag{5}$$

It should be clear that one takes the boundary values $\pm\mu_sF_N(x)$ if this relation does not hold. The shape of the friction source term is illustrated in FIG. 2.

Figure 2:
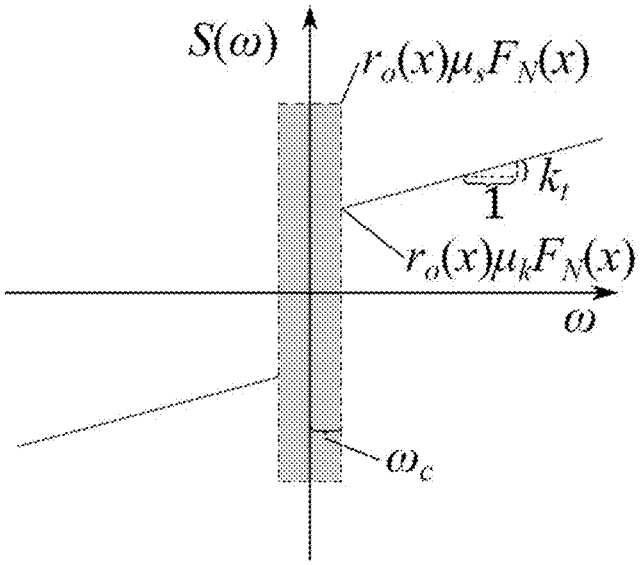
FIG. 2 is a schematic illustrated friction source terms and angular velocities as used in the explanations in the detailed description of the various aspects of the present invention.

It should be noted that FIG. 2 is a schematic illustrating the friction source term $S(\omega,x)$ (as S can be expressed as a function of $\omega$). In FIG. 2, the shaded region represents the angular velocities for which a constant value of static torque is assumed, and the red curve indicates the dynamic torque as a function of angular velocity.

Using the torque model of one of the references listed below, it is possible to derive the normal force profile $F_N(x)$.

Assuming a planar well and torsional rotation of the drill string the normal force in terms of the tension profile $\sigma_e$ writes:

$$\sigma_e(x)=\int_L^x W_b(\xi)\cos\theta d\xi, \tag{6}$$

where $W_b(x)$ is the buoyed weight per meter and $\theta$ is the angular profile. The normal force profile, $F_N$, is obtained as $$F_N(x)=\left(\sigma_e(x)\frac{\partial\theta}{\partial x}+W_b(x)\sin\theta\right). \tag{7}$$

Discontinuities of a Multiple Sectioned Drill String

The lower part of the drill string is usually made up of drill collars that may have a great impact on the global dynamics due to their inertia. Due to the change of the characteristic line impedance, the transition from the pipes to collars in the drill string will cause reflections in the traveling waves. We split the drill string into a pipe section and a collar section. The corresponding inertia, length, density and shear modulus are respectively denoted $J_p, L_p, p_p, G_p$ and $J_c, L_c, p_c, G_c$. We use $\tau^+, \omega^+$ to denote the strain and velocity at the top of the drill collar and $\tau^-, \omega^-$ at the bottom of the pipe. The boundary conditions at the transition are given by the following continuity constraints $$\omega^+=\omega^-, \tau^+=\tau^-.$$

Top-Drive Boundary Condition

The top drive at the topside boundary is actuated by a motor torque, $\tau_m$, that is in most cases controlled using a PI control law to reach a desired velocity set point $\omega_{SP}$:

$$e=\omega_{SP}-\omega_{TD}, \tag{8}$$

$$I_e=\int_0^t e(\xi)d\xi, \tag{9}$$

$$\tau_m=k_p e+k_i I_e, \tag{10}$$

where $k_p$ is a proportional gain and $k_i$ an integral gain. We denote $I_{TD}$ the topdrive inertia. From this, we arrive at the following equation $$\frac{d_{\omega_{TD}}}{dl}=\frac{1}{l_{TD}}(\tau_m-\tau(t,0)) \tag{11}$$

In what follows, we denote $\omega_0=\omega(t,0)$ as the angular velocity at the top of the drill string. This verifies that $\omega_0=\omega_{TD}$.

Riemann Invariants

The Riemann invariants of a Hyperbolic PDE are the states that correspond to a transformation of the system for which the transport matrix has been diagonalized. With such a transformation, it becomes possible to write the system as a series of transport equations that are coupled through the source terms. They are defined by $$\alpha_i=\omega_i+\frac{(c_t)_i}{J_iG_i}\tau,\ \beta_i=\omega_i-\frac{(c_t)_i}{J_iG_i}\tau, \tag{12}$$

where $$(c_t)_i=\sqrt{\frac{\rho_i}{J_i}}$$

is the velocity of the torsional wave and where the index i=c if we consider the collar section and i=p if we consider the pipe section. The full derivation and an analysis of the effectiveness of this modeling approach has been explored in some details in the Aarsnes reference listed below.

Estimation of the Tool Face Orientation

The model referenced in the previous section has been used to estimate downhole and along-string angular velocity and torque and has been validated with field data. This section details the process to estimate, in real time, the tool face orientation. The tool face orientation is denoted by $\varphi_b(t)$ and is defined by $$\varphi_b(t)=\int_0^t\omega(v,L)dv+\varphi_0,$$

where $\varphi_0$ corresponds to the initial tool face orientation. More precisely, the observer designed in the 2019 Aarsnes reference (listed below) combines the proposed model of the system dynamics with measurements from physical sensors. This observer relies on the measured top-drive angular velocity Wo. To be able to estimate the downhole orientation (which is the integral of the velocity), we also require downhole measurements, which may be sparse or latent.

During directional drilling operations, downhole measurements of the tool face orientation are transmitted to surface infrequently (on the order of once per minute to once per hour) and with considerable delay (on the order of seconds). Typical downhole sensors contain one to three axis accelerometers or gyroscopes and one to three axis magnetometers. These sensors are sampled at frequencies between 1-100 Hertz by the downhole tool, but only averaged or windowed values are transmitted to surface. For human-in-the-loop operations, this is found to be sufficient since orienting the tool face takes between one and fifteen minutes. However, for automated solutions, in particular feedback controllers, this leads to significant performance degradation. Thus, the ability to estimate tool face in real-time provides the potential to significantly improve automated tool face orientation operations.

In experiments involving the present invention, among the assumptions was a sampling rate of the tool face orientation measurements of 0.1 Hertz (i.e. every $T_7$=10 s), and with a delay of $\tau_7$=10 s. These are representative of a typical onshore horizontal well drilling operation. Consequently, these delayed tool face measurements cannot be used directly to update the observer estimates but must be compared to the observer estimate from the time the measurement was actually taken, based on which error the state estimate can be updated.

The estimation of the tool face orientation is obtained improving the soft-sensor introduced in the 2019 Aarsnes reference and based on the backstepping methodology of the Di Meglio reference. This adaptive observer process provides reliable estimates of the states (torque and angular velocity) of the system and of the friction coefficients related to the side forces ($\mu_s$ and $\mu_k$) using the measurement of $\omega_0$.

Observer Equations

For this section we use the observer equations given in the 2019 Aarsnes reference as a copy of the plant equation plus some correction terms and then use these to derive an estimate of the tool face, $\hat{\phi}_b(t)$, as given in Equation (24).

Let us denote with the ^superscript the estimated states and $e=\hat{\omega}_0-\omega_0$ the measured estimation error of the top-drive angular velocity. The observer equations given in the 2019 Aarsnes reference in terms of Riemann invariants read as follows $$\dot{\hat{\omega}}_O = a_0\left(\hat{\beta}_p(t, O) - \hat{\omega}_0\right) + \frac{1}{I_{TD}}\tau_m - p_0 e, \tag{13}$$

$$\frac{\partial \hat{\alpha}_i}{\partial t}(t, x) + (c_t)_i \frac{\partial \hat{\alpha}_i}{\partial x}(t, x) = \hat{S}_i(t, x) - p_\alpha^i(x)e, \tag{14}$$

$$\frac{\partial \hat{\beta}_i}{\partial t}(t, x) + (c_t)_i \frac{\partial \hat{\beta}_i}{\partial x}(t, x) = \hat{S}_i(t, x) - p_\beta^i(x)e, \tag{15}$$

where the index i=c if we consider the collar section and i=p if we consider the pipe section. The source term in each section are computed from the estimated states and friction factor $$\hat{S}_i(t, x) = k_t\left(\hat{\alpha}_i(t, x) + \hat{\beta}_i(t, x)\right) + \frac{1}{J_i\rho_i}\hat{\mathcal{F}}_i(t, x), \tag{16}$$

where $\mathcal{F}$ has an expression analogous to Equation (4), the different variables being replaced by their estimates. Finally, the boundary conditions at the top and bottom, and between the drill string sections, are $$\hat{\alpha}_p(t,0) = 2\hat{\omega}_0(t) - \hat{\beta}_p(t,0) - P_0 e, \tag{17}$$

$$\hat{\beta}_p(t, L_p) = \frac{\alpha_p(t, Lp)\left(1 - \overline{Z}\right) + 2\overline{Z}\hat{\beta}_c(t, L_p)}{1 + \overline{Z}} - P_1 e, \tag{18}$$

$$\hat{\alpha}_c(t,L_p) = \frac{2\overline{Z}\hat{\alpha}_p(t, Lp) - \left(1 - \overline{Z}\right)\beta_c(tL_p)}{1 + \overline{Z}}, \tag{19}$$

$$\hat{\beta}_c(t,L) = \hat{\alpha}_c(t,L), \tag{20}$$

where Z is defined as $$Z = \left[\frac{c_t}{JG}\right]^+ / \left[\frac{c_t}{JG}\right]^-. \tag{21}$$

The estimates of the friction factor are updated according to $$\dot{\hat{\mu}}_s(t) = \begin{cases} -l_s e, & |\hat{\omega}_{L_c}| \le \omega_c \\ 0, & |\hat{\omega}_{L_c}| > \omega_c \end{cases} \tag{22}$$

$$\dot{\hat{\mu}}_k(t) = \begin{cases} 0, & |\hat{\omega}_{L_c}| \le \omega_c \\ l_k e, & |\hat{\omega}_{L_c}| > \omega_c \end{cases} \tag{23}$$

Finally, the following saturation is used to improve robustness of the method: $\hat{\mu}_s = \max(\hat{\mu}_s, \hat{\mu}_k)$. The different constant and observer gains $a_0, p_\alpha^i, p_\beta^i, p_0, p_1, P_0, P_1, l_s, l_k$ are given in the 2019 Aarsnes reference. The initial condition of Equations (13)-(20) can be arbitrarily chosen. This observer has been tested in the 2019 Aarsnes reference against field data where it was shown as being capable of providing a good estimation of the downhole velocity and of the side-forces friction parameters in the situation of an off-bottom bit. However, to estimate the tool face orientation, this needs to be combined with the available (but delayed) orientation measurements. These measurements are available every $T_T$ with a lag of $\tau_T$. Thus, our tool face estimation can only be corrected every $T_T$ seconds. More precisely, for any $k \ge 1$ and $kT_T \le t < (k+1)T_T$, we consider the following estimator $$\hat{\phi}_b(t) = \int_0^t \frac{\hat{\alpha}(v, t) + \hat{\beta}(t, v)}{2} dv - \left(\hat{\phi}_b(kT_T - \tau_T) - \phi_b(kT_T - \tau_T)\right). \tag{24}$$

This estimation law is tested in simulations below.

Simulation Results

In this section, it is shown that the extended observer defined by Equations (13)-(24) provides a reliable estimation of the tool face orientation in simulation. The simulation model used is described in the references listed below with the wellbore survey shown in FIG. 3, using the numerical implementation described in another of the references listed below. The kinetic friction is chosen to be equal to 0.28, while the static friction is chosen to be equal to 0.45 which is similar to values reported using traditional friction tests in the field. The well represents a simple build used throughout the world. More discussion of this synthetic example, and reasoning for the choice of machine and system parameters, may be found in the 2018 Aarsnes reference.

Figure 3:
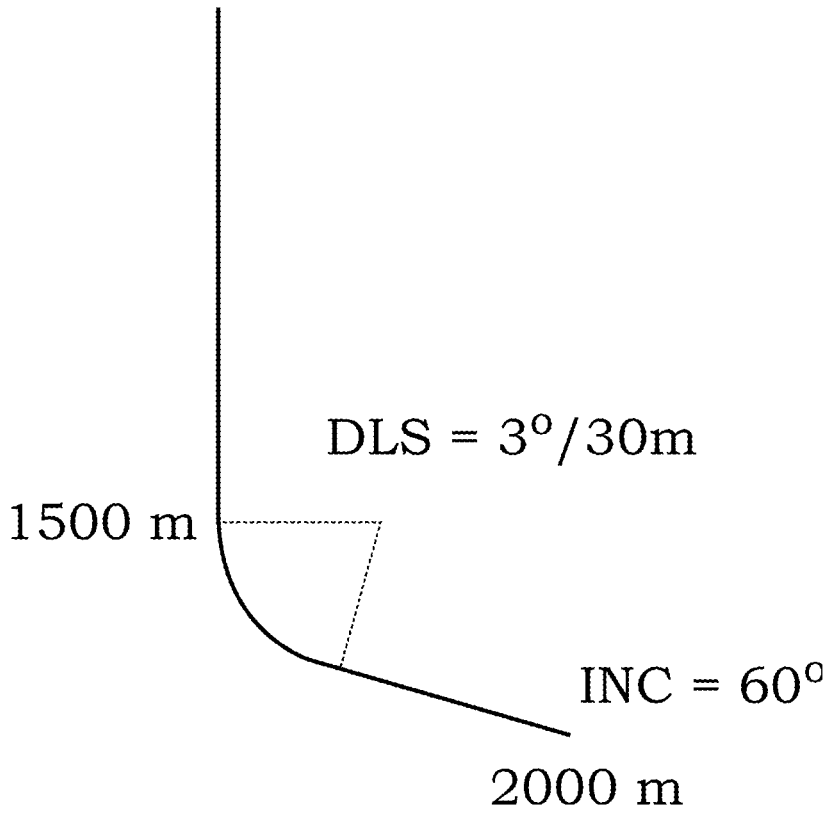
FIG. 3 is a wellbore survey for a simulation model used in testing one aspect of the present invention.

Referring to FIG. 3, illustrated is a wellbore survey for the simulation model. For this figure, the lateral section is built with a 3°/30 meter Dog-Leg Severity (DLS), which kicks off at 1500 meters Measured Depth.

Figure 4:
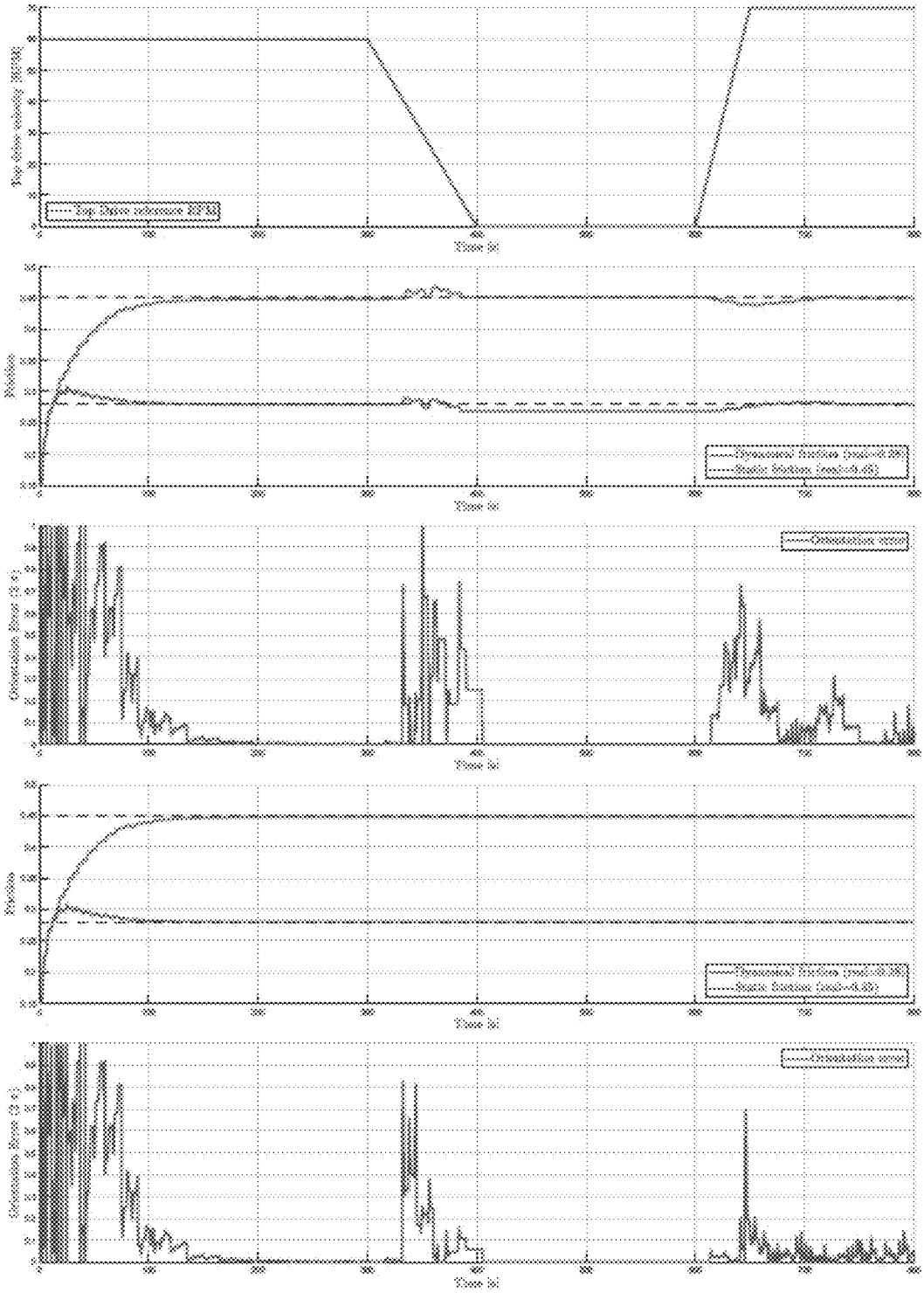
FIG. 4 are plots of drive velocities, estimates of friction parameters, and tool face orientation errors.

We consider a first scenario for which the top-drive velocity is tracking a reference trend (given in FIG. 4, top) using a simple PI control law. It is assumed that the tool face orientation measurements are available every $T_T$=10 s with a lag of $\tau_T$=10 s. We have pictured in FIG. 4 (second subplot) the estimation of the friction coefficients which are given by our observer. The tool face orientation error (i.e. the difference between the real and estimated orientation in number of turns) is plotted in the third subplot of FIG. 4. From these simulations, it can be seen that the estimated orientation only converges toward the real one once the estimation of the friction terms provided by our observer becomes accurate enough. Moreover, any change in reference may create a transient during which the estimation of the friction terms is deteriorated. This, in turn, yields poor tool face estimates (see FIG. 4, between 300 s and 400 s for instance). To avoid the deterioration of these friction estimates when the drill string is stationary, it is proposed that the driller sets a constant reference top drive velocity. This value is chosen large enough to guarantee enough excitation in the system (in particular, it is necessary that the torque breaks the static friction limitation). Once the estimates of the friction parameters given by our observer have converged, these values are kept fixed. Thus, a change of reference will not imply new updates of the friction parameters estimation. This procedure is tested in simulations against the same scenario. Pictured in FIG. 4 are the new estimation of the friction parameters (fourth subplot) and the tool face orientation error (last subplot). The accuracy of the orientation estimation is considerably improved compared to the previous case. The results are satisfactory for field applications, for which an estimation error of 0.25 turn for the orientation is acceptable. Note that, as the friction parameters may slightly change with time, one can regularly repeat such a procedure to update the friction coefficients.

It should be clear that FIG. 4 shows top drive velocity (top), estimated friction coefficients (second), orientation error (third) using the observer (13)-(24), estimated friction coefficients when the estimation is stopped when t≥200 s (fourth) and orientation error when the estimation is stopped when t≥200 s (bottom)

Control of the Tool Face Orientation

In this section we consider the problem of the control of the tool face orientation.

More precisely, given a final reference $\phi_b^f$, we want to design a reliable procedure to reach such a reference when the tool face stops rotating.

State of the Art for Tool Face Control

Interest in closed loop control systems for directional drilling control has increased in the past three decades, particularly for well manufacturing scenarios—where many wells are drilled off the same well pad—and to reduce costs. On current state-of-the-art land drilling rigs, tool face is predominantly controlled by a human directional driller interacting with a manual or semi-automatic top drive control system. Some systems require the human driller to bump (i.e. change) tool face through either angular position or angular velocity inputs to the top drive. The directional driller maintains a memory, or notepad, of previous bumps or changes and the resulting change in tool face position, and reverts to these notes for subsequent bumps. More advanced systems implement some form of pipe rocking—an oscillation of top drive angular position to 'break' static friction along a portion of the horizontal drillpipe in sliding operations—and to thereby bundle the tool face bumping procedure as part of a semi-automated rocking routine. Several feedback control systems have been tested in the field for closed loop tool face control, but these have struggled to outperform human drillers, and thus remain in limited deployment and results remain unpublished. The root cause often reported for such issues is the latency of tool face measurement and the non-linear nature of static and kinematic friction. Moreover, a crucial point is that one cannot directly act on the state $\phi_b$, but only on its derivative $\omega(t,L)$. In the following sections we recall the existing results regarding the control of Bottom Hole Assembly (BHA) velocity, before presenting three potential closed loop control strategies for the tool face orientation.

Feedback Controllers for the BHA Velocity

As we can only act on the orientation by modifying the BHA velocity (using a top-drive actuation), it might be of interest to consider feedback laws that have been designed to control BHA velocity while avoiding the effects of stick-slip. For a majority of drilling rigs in the field, the actuation is done through AC electric top drives, using a variety of variable frequency drives which are capable of highly accurate, high frequency, rotary speed control. Two types of stick-slip mitigation controllers have been widely deployed: the older SoftTorque-SoftSpeed systems and the newer ZTorque systems. These control laws have been proved to be more efficient compared to simple stiff PI controller. Such control laws have been improved on by completing them using a feed-forward action that does not disturb their closed-loop behavior. Due to its simplicity, the industry standard controller that is most often used is a high gain PI control to ensure rapid tracking of the top drive set point. The control signal has the following structure $$\tau_m = -(C^*(\omega_{SP} - \omega_0)), \tag{25}$$

where $\omega_{SP}$ is the set point for the top drive velocity and where the controller impulse response C(t) is composed of a proportional term and of an integral term as described in Equation (10). This kind of controller has been improved to handle and compensate for the effect of torsional vibrations and can be used to stabilize the downhole velocity around the same set point wsp.

SoftTorque and ZTorque

The current industry standards in handling torsional vibrations are the two products NOV's SoftSpeed and Shell's SoftTorque. The objective of these solutions is to reduce the reflection coefficient at the top drive in a certain key frequency range. Some improvements for this stick-slip mitigation control have been done by Shell in ZTorque. In this new solution, the reflection coefficient of the top drive is minimized for a wider range of frequencies by measuring the torque between the drill string and top-drive. The feedback control law is used to "artificially" have the top-drive match the impedance of the drill-pipe, $$\zeta_p = J_p\sqrt{G_p\rho}.$$

Figures 5, 6:
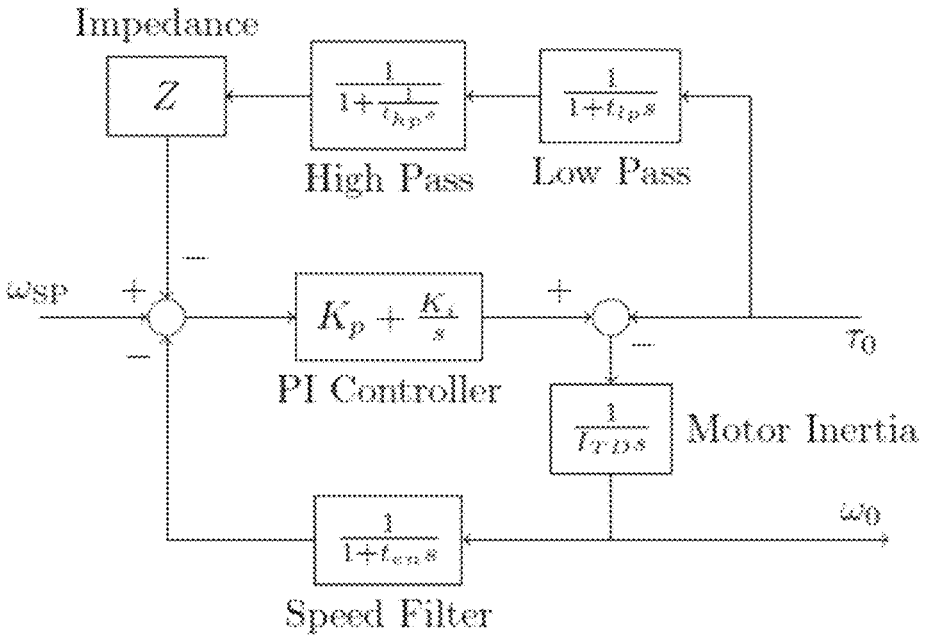
FIG. 5 is a control diagram for a ZTorque system.
FIG. 6 is a table comparing requirements and performances for the three aspects of the present invention.

The block diagram of the Z-torque control law is given in FIG. 5.

It should be clear that FIG. 5 illustrates a control diagram for a ZTorque system with direct pipe torque measurement. For ZTorque, $$Z = \frac{1}{\zeta_p}$$

is used. If Z=0, the control diagram is equivalent to a SoftTorque or stiff speed controller system.

It has been shown in the literature that the Z-torque control law effectively removes stick-slip oscillations at the costs of delivering high instantaneous torque to the top drive to allow for impedance matching through rapid velocity changes and a significantly slower response in rotational velocity of the top-drive. Z-torque also requires extra instrumentation, namely a measurement of the torque acting from the drill string on the top-drive, to work effectively.

Feed-Forward Trajectory Design

A strategy to avoid torsional stick-slip oscillations (especially at the start-up of a drilling operation) has been developed in the literature. It consists of using a feed-forward controller that can be added to the standard industry feedback controllers. This feed-forward control law can be used to track any downhole velocity profile. The control signal is now composed of three terms $$\tau_m = u_c + u_f \pm u_d, \tag{26}$$

where $u_c(t) = -(C^*(\omega_{SP} - \omega_0))(t)$ is a feedback term, $u_f$ is a feed-forward term that ensures tracking, and $u_d$ corresponds to a compensation of the friction term (which is modeled as a disturbance). This conforms to a canonical 3DOF (degrees of freedom) controller architecture. Note that the disturbance feed-forward term is needed since the disturbance canceling imposes a trajectory on the top-drive velocity. More precisely, this controller exploits the differential flatness of the model, which means that the control input can be parametrized as a function of one output (here the BHA velocity $\omega(t,L)$). Such a control law has been tested in an extensive simulation study with the field data validated simulation model.

Tool Face Orientation Control Procedures

In this section, we describe three procedures/processes to control the tool face orientation. These procedures exploit the improved precision and data utilization enabled by automatic control. These three procedures vary in terms of requirements on available instrumentation and model accuracy and in terms of time needed to be completed. The three processes are detailed as follows:

1. Feed-forward control: This procedure/process starts with stable rotation off-bottom and assumes the availability of an estimate of current tool face orientation. Using the flatness of the drilling system, an admissible trajectory is generated that controls the tool face orientation to the desired value at the same time as bit-rotation stops. The flatness property of the model is used to obtain the required actuation and measurement trends which are then tracked by the 3-DOF controller described in above.

Requirements: Stable off-bottom rotation, good model of the drill string and correct estimate of tool face orientation while rotating.

Performance: One iteration: Correct orientation immediately when stopping.

2. Rotating iteration: In this procedure/process we again require stable rotation off-bottom, but use no assumption on model correctness. During rotation off-bottom, we smoothly change the reference to zero to stop bit rotation. As the delayed measurement of the stationary tool face orientation is obtained, a heuristic relationship between the set point change and tool face orientation can be established, and the desired orientation is achieved by iterating the procedure.

Requirements: Stable off-bottom rotation, correct estimate of tool face orientation while rotating.

Performance: Two iterations.

3. Bump iteration: This procedure/process rotates the top-drive up to the release torque, and the top-drive velocity reference is then changed by a bump. This bump induces a change of orientation for the tool face. By iterating, with changes in the amplitude of the bump, one can estimate the parameters of an affine relation between the bump amplitude and the corresponding change in tool face orientation. After two iterations, the correct amplitude can be computed, and the correct tool face achieved on the third iteration.

Requirements: None.

Performance: Three iterations.

The performance and requirements of these three different procedures are summarized in Table 6.

Feed-Forward Procedure

As explained in the 2018 Aarsnes reference, a feed-forward control law can be added to the standard industry feedback controllers to track any downhole velocity profile. These trajectory profiles are usually constructed using a mollifier (semi-analytical function), which guarantees that the transition trajectories are booth smooth and have vanishing derivative at the end and start point. This procedure requires steady rotation off-bottom. For many wells this requires the use of Z-torque or other feedback control (or the startup procedure described in the 2018 Aarsnes reference) to achieve. In the present simulation study, a rig with the Z-torque control is assumed. Once this steady state is reached (at time $T_0$), we estimate the current orientation using our observer. We are able to define a reference trajectory to that takes us from this current tool face orientation to the final desired one (eventually adding it $2k\pi$ to have a realistic smooth trajectory). From this trajectory, we can generate the corresponding BHA velocity trajectory. Using the flatness property of the model, we obtain the control input that tracks this trajectory. We finally use the feed-forward control law (see Equation 26) to reach the desired orientation. This procedure is described in Process 1. It has been tested in simulation against the model described in the literature with the wellbore survey shown in FIG. 3. The kinetic and static friction coefficients are still chosen as 0.28 and 0.45, respectively, which is similar to field scenarios. The desired orientation is set to $\pi/4$ radians (=0.125 turn or 45°). The actuation is subject to a maximum torque saturation of 30 kNm. In this scenario, we assume that the friction parameters are known (or have been estimated using the procedure described above). The different results are pictured in FIG. 7.

Figure 7:
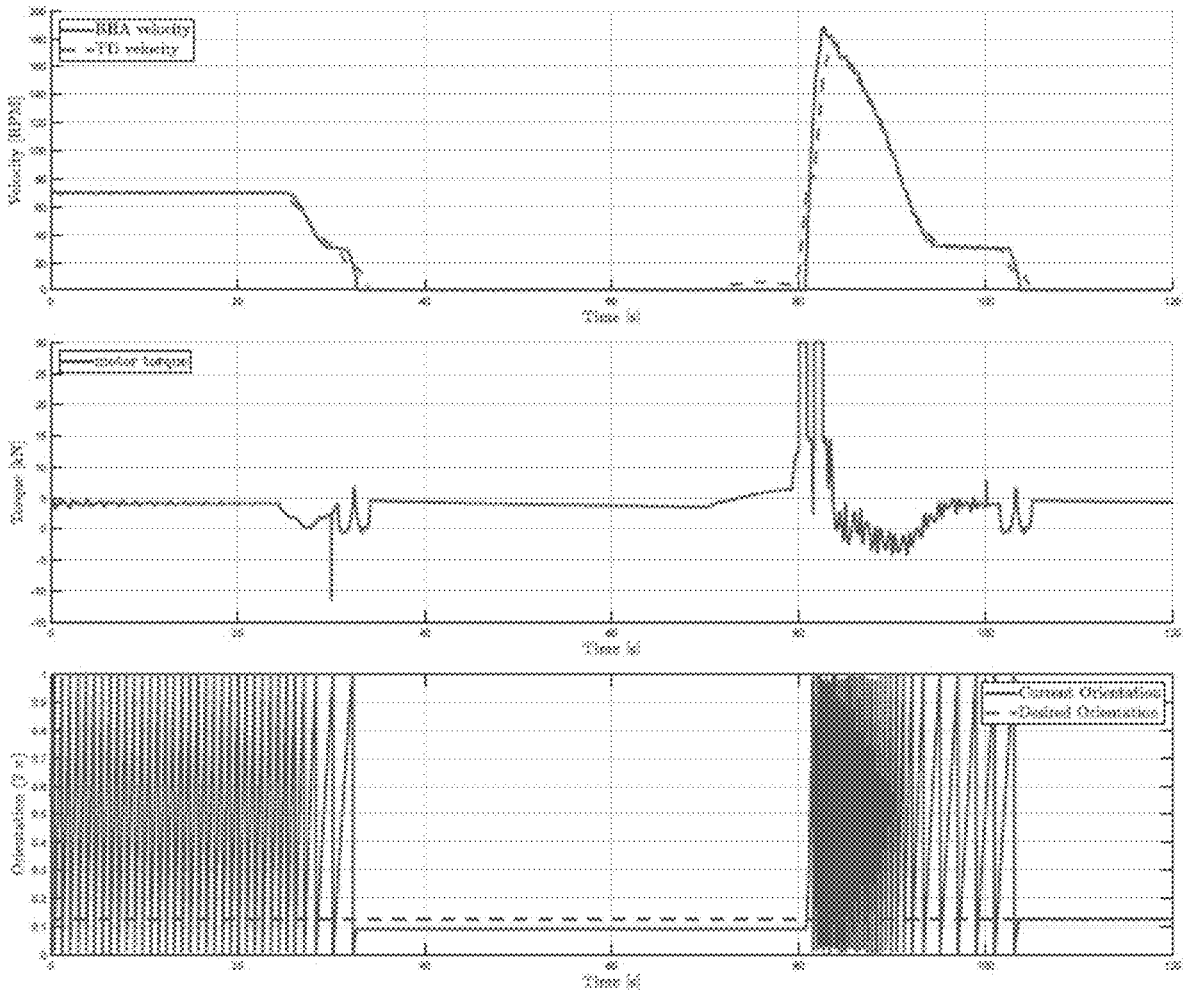
FIG. 7 are plots of the time evolution of the top drive and BHA velocity, of the toque, and the orientation of the tool face for the Process 1 aspect of the present invention.

FIG. 7 shows the time evolution of the top drive and BHA velocity (top), of the torque (middle) and the orientation, expressed in turns (bottom) using the feed-forward flatness control of the BHA orientation (Process 1). The control is shown both from a steady orientation and from a stationary condition. The desired orientation is equal to $\pi/4$ radians (=0.125 turn).

Process 1 can be summarized using the following steps:

Process 1: Feed-forward control

1: Stabilize the BHA velocity $\omega_L$ around the set point $\omega_L^{ref}$ using Z-Torque.

2: Once the steady-state $\omega_L^{ref}$ is reached, using the estimation law (See Equation 24), estimate the tool face orientation $\phi_b^0$ at time $T_0$.

3: Generate a trajectory that stirs the current orientation to the desired orientation.

4: Integrating this trajectory, generate the corresponding trajectory for the BHA velocity.

5: Using the flatness property of the model, generate the corresponding control input.

6: Using the feed-forward control law (See Equation 26) as described in the 2018 Aarsnes reference, stabilize the system around this reference.

Rotating Iteration

The idea in this procedure/process consists of stirring the system into the same initial state, for which the BHA velocity is constant. Hence, stable rotation is assumed. Once this steady state has been reached, we smoothly change the velocity reference to zero. Using our observer and the available measurements, we can then estimate the variation of orientation induced by the change of reference. Based on the obtained result, we can adjust the procedure accordingly, anticipating the variation of orientation induced by the change of reference and stopping the actuation earlier (using the estimation of the orientation given by our observer).

The desired orientation will be denoted $\phi_b^f$, while the constant BHA velocity set point will be denoted $\omega_{TD}^{ref}=\omega_L^{ref}$ (for instance $\omega_L^{rere}$=25 RPM). This set point has to be large enough to break the static friction and initiate rotation. The complete procedure is described in Process 2 below.

Process 2 can be summarized by the following steps:

Process 2: Rotating iteration

1: Stabilize the BHA velocity $\omega_L$ around the set point $\omega_L^{ref}$ using Z-Torque.

2: Once the steady-state $\omega_L^{ref}$ is reached, using the estimation law (see Equation 24), estimate the tool face orientation $\phi_b^0$.

3: Change the velocity reference by a smooth function that goes to zero.

4: Wait for the delayed measurement of the stationary tool face orientation $\phi_b^1$.

5: Define $\phi_b^2 \equiv \phi_d^f + \phi_b^0 - \phi_d^1$ [modulo $2\pi$]. Repeat step (1). Once the system has reached its steady-state wait until $\phi_b(t)=\phi_b^2$. Then, immediately change the actuation by the same smooth function.

6: Iterate step (4), if the orientation is not correct.

Figure 8:
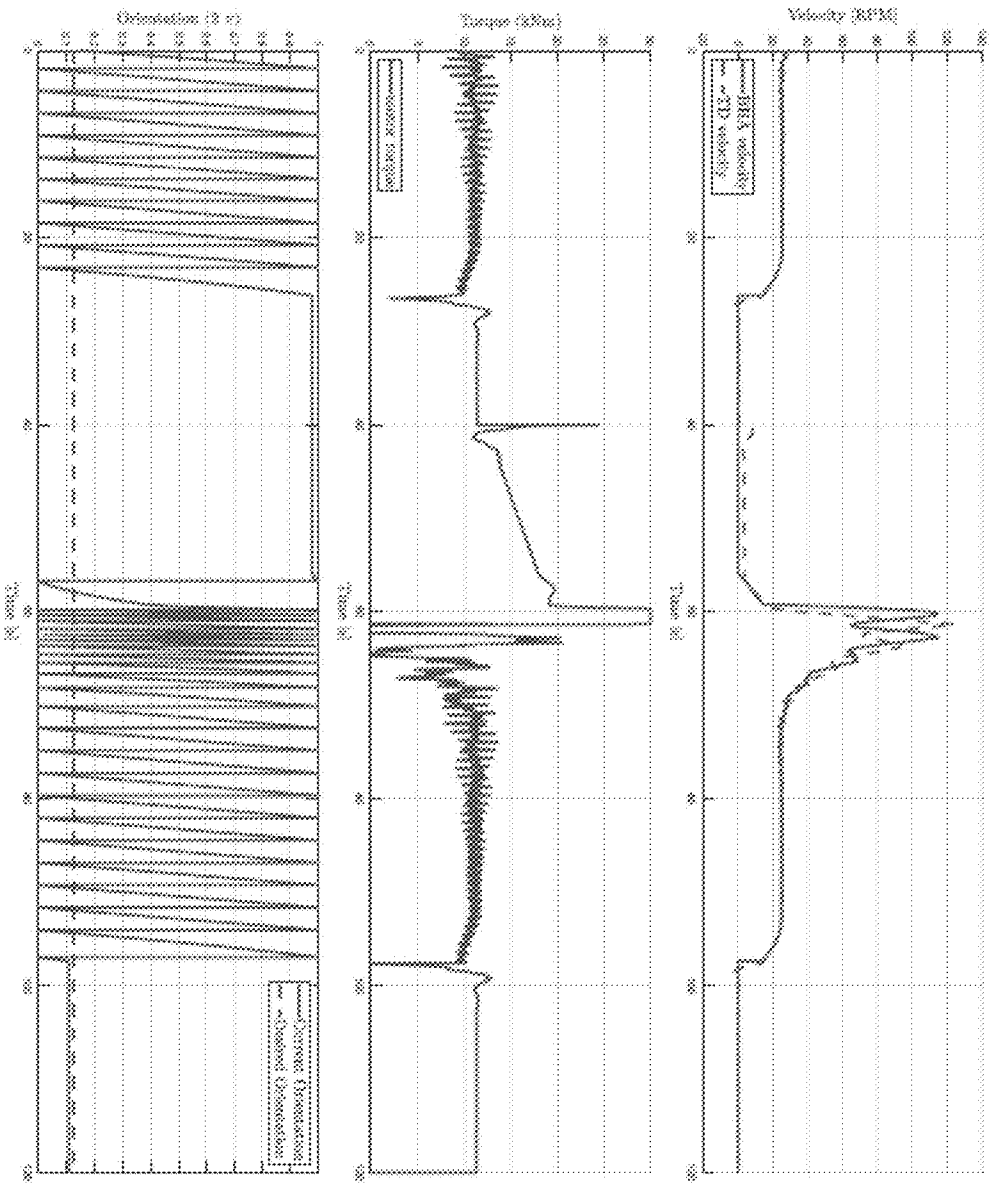
FIG. 8 are plots of the time evolution of the top drive and BHA velocity, of the toque, and the orientation of the tool face for the Process 2 aspect of the present invention.

Note that the quantity $\phi_b^2 \equiv \phi_b^f + \phi_b^0 - \phi_b^1$ [modulo $2\pi$] corresponds to the difference between the desired orientation and the variation of orientation induced by the change of reference. Such a procedure has been tested in simulation against the model described in the literature with the wellbore survey shown in FIG. 3. The kinetic and static friction coefficients are still chosen as 0.28 and 0.45, respectively, which is similar to field scenarios. The desired orientation is set to $\pi/4$ radians (=0.125 turn or 45°). The actuation is subject to a maximum torque saturation of 30 kNm. We have pictured in FIG. 8 the evolution of the BHA and top drive angular velocity, of the top drive torque and of the tool face orientation.

In this ideal situation (i.e. no delay or noise), Process 2 provides excellent results. The main drawback of such a procedure is that it requires knowledge of the orientation at each time (to know when the actuation has to be stopped). Thus, the performance of the procedure is directly related to the accuracy of the observer estimates.

It should be clear that, as noted above, FIG. 8 shows that time evolution of the top drive and BHA velocity (top), of the torque (middle) and the orientation, expressed in turns (bottom) following Process 2. The desired orientation is equal to $\pi/4$ radians (=0.125 turn).

Bump Iteration

This last procedure/process relies on the fact that the BHA (bottom hole assembly) can only start rotating once there is enough energy in the drill string. This means that the motor torque has reached a critical value (which corresponds to the static torque imposed by the side forces), known as the release torque. The proposed approach consists in stirring the system into this known repeatable state (for which the motor torque has almost reached its release value) and then setting a bump or input increase as the new top-drive velocity set point. Due to the consequences of Equation (4), once the release torque is reached, we have a linear relation between the amplitude of the bump which is sent and the corresponding change of tool face orientation. This is due to the fact that when the drill string breaks free from the static friction, the system dynamics are linear (the kinematic friction term is linear). We can then measure the change of orientation induced by the bump. Using the linearity, we can adjust the bump amplitude and repeat the procedure. More precisely, let us consider a stationary drill string for which we can measure the tool face orientation $\phi_b^{1-}$ using the available sensor. We then stabilize the top-drive velocity around a given small reference (namely 15 RPM). The torque in the drill string progressively increases. Once the top-drive torque (which can be directly measured) almost reaches its release value, we change the constant top-drive velocity reference by a bump with a given amplitude $A_1$ (that has to be large enough). Due to this bump, as the release torque is reached, the drill bit starts rotating for a short period of time. After the operation, we can measure the resulting tool face orientation $\phi_b^{1+}$ and compute the variation of orientation induced by the bump $(\Delta\phi)_1=\phi_b^{1+}-\phi_b^{1-}$. We then iterate the procedure adjusting the amplitudes of the bump and using the linear relation between the amplitude of the bump and the change of orientation induced by this bump. As described below, after several bumps, the bit orientation reaches its desired value. The first part of the procedure is necessary to guarantee the same initial condition before sending the bump (just before the release torque). This requires knowledge of the value of the release torque. This value can be estimated using the method presented in the 2018 Aarsnes reference (that, however, requires the estimation on the friction terms, which is possible using our observer). The friction terms will be assumed to be known this study. It is worth mentioning that this procedure does not require an estimate of the orientation as we only have to wait until the required measurements become available.

Regarding the duration of the bump or change, the duration is preferably adjustable and can be user selected or automatically selected. Selection of the duration may be based on prior knowledge or on calculations of the number of rotations needed at surface to cause a specified change in orientation (or rotation) at the bottom hole assembly.

The complete procedure is summarized in Process 3 below.

This procedure has been tested against the simulation model described in above (with a torque saturation of 30 kNm). For this model, the release torque is equal to 17 kNm. We choose the top-drive reference velocity to be equal to 15 RPM, while the bit-orientation we want to reach is equal to $\pi/4$ radians (=0.125 turn).

Table 2 shows the variations of orientation $(\Delta\phi)_i$ induced by different bumps. The bumps have the same duration, only their amplitudes $A_i$ begin different. The amplitudes are chosen such that the difference $(d_A)_i=A_i-A_{i-1}$ remain constant. The relative variation of orientation after each bump is expressed in terms of turn, instead of radians (which explains why the different values are all in the interval [0,1)).

TABLE 2

| Iteration | $A_i$ | $(\Delta\phi)_i$ | $(\Delta\phi)_i-(\Delta\phi)_{i-1}$ |
|---|---|---|---|
| 1 | 5.2 | 0.79 | N.A |
| 2 | 5.3 | 0.823 | +0.024 |
| 3 | 5.4 | 0.849 | +0.026 |
| 4 | 5.5 | 0.875 | +0.026 |
| 5 | 5.6 | 0.901 | +0.026 |
| 6 | 5.7 | 0.928 | +0.027 |

Table 2 also shows the results of the computation of $(\Delta\phi)_i$ and $(\Delta\phi)_i-(\Delta\phi)_{i-1}$ (expressed in turns) for 6 different bumps (whose amplitudes are characterized by $A_i$)

Using the results given in Table 2, it is possible to model $(\Delta\phi)_i$ as an affine function of $A_i$. We obtain the following linear regression (where $\Delta$ is the slope of the regression):

$$(\Delta\phi)_i=0.26(A_i-5.2)+0.79[\text{modulo } 1]=\Delta(A_i-A_1)+(\Delta\phi)_1[\text{modulo } 1], \quad (27)$$

However convenient this linear expression may appear at first sight, one must be aware that, due to the fact that we are only able to measure the relative variation of the tool face orientation, it can only be used to compute the relative variation of orientation when $A_i=A_0+n(d_A)$ (n being an integer). An example illustrates the issue. If a variation of amplitude of $d_A$ implies a relative change of orientation of 0.2 turns, then a variation of amplitude of $10d_A$ would imply a relative change of orientation of 2 turns, which will be seen as 0 (no relative displacement). Thus, knowing only the relative change of orientation for a variation of amplitude of $10d_A$ it becomes impossible to guess a relative change of orientation induced by a change of amplitude of $d_A$. This limitation implies that the desirable orientation cannot be perfectly reached. Thus, $d_A$ has to be chosen small enough to guarantee an acceptable precision. IT should thus be clear that, if the variation of orientation is known absolutely (in number of turns) and not relatively, this problem disappears. This can be achieved by using the orientation estimation provided by Equation (24).

Being aware of this intrinsic limitation, expression (27) can be used to obtain the amplitude of the future bump or input increase we have to send. In the considered example, we initiate the procedure with two bumps for which $A_1=5.2$, $A_2=5.3$. Before sending the third bump, we measure $\phi_b^{3-}$. As we want $\phi_b^{3+}=0.125$ we can compute the corresponding orientation variation $(\Delta\phi)_3$ we need to generate. Using Equation (27), we obtain the corresponding bump amplitude $A_3$ (here we have chosen $A_3=4$). We have pictured in FIG. 9 the time evolution of the topdrive and BHA velocity, motor torque and tool face orientation for this example. Note that a torque saturation of 30 kNm has been used in these simulations. For this example, only three bumps were required.

Figure 9:
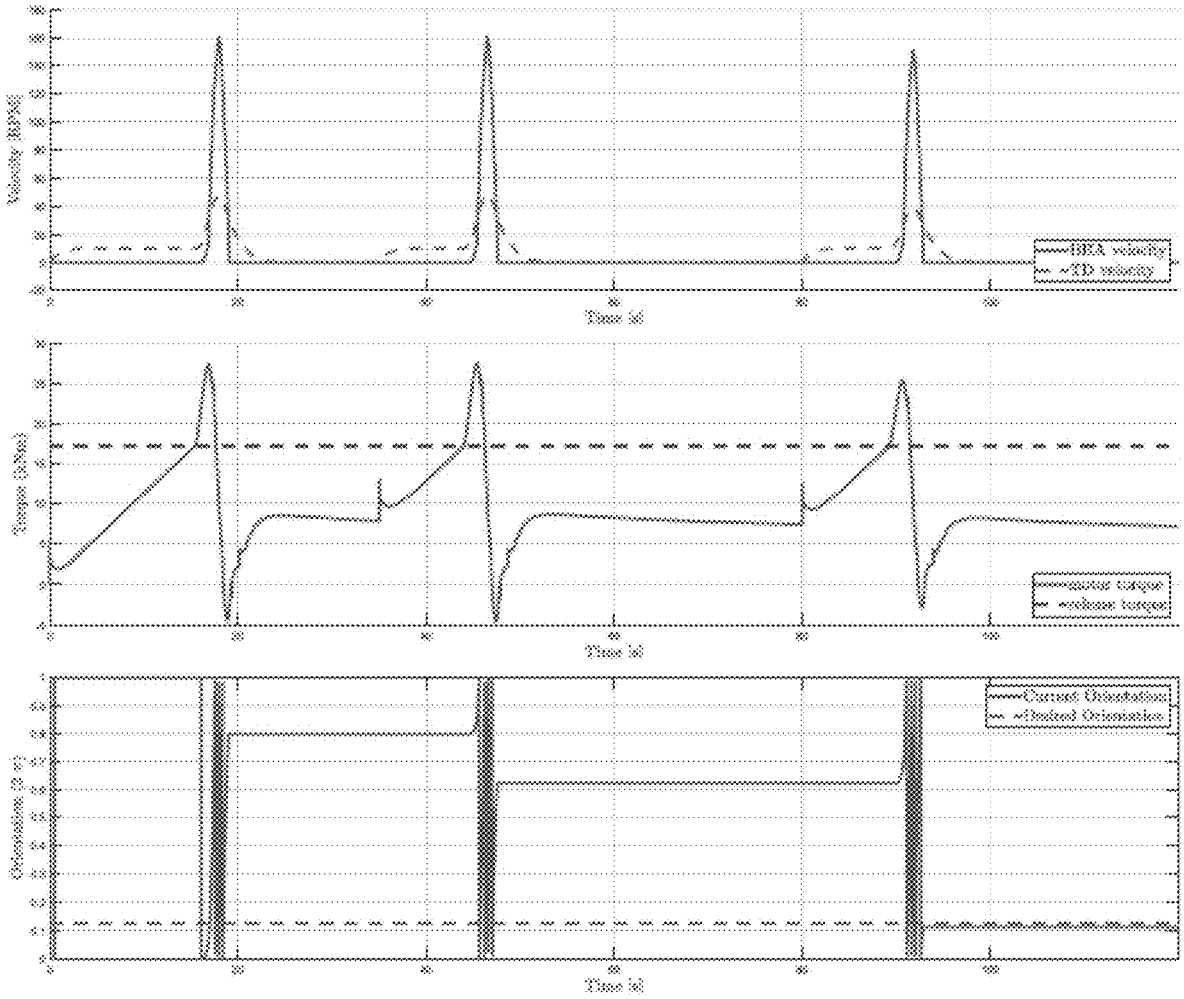
FIG. 9 are plots of the time evolution of the top drive and BHA velocity, of the toque, and the orientation of the tool face for the Process 3 aspect of the present invention.

As can be seen, FIG. 9 shows that time evolution of the top drive and BHA velocity (top), of the torque (middle) and the orientation, expressed in turns (bottom) following Process 3. The desired orientation is equal to $\pi/4$ radians (=0.125 turn).

The whole procedure can be summarized by Process 3 below.

Process 3: Bump iterations

1: Stabilize the top drive velocity Wo around the set point $\omega^{ref}$ using a PI control law.

2: Just before the motor torque reaches its release value, send a bump with an amplitude $A_1$ as the new reference. Compute $(\Delta\phi)_1$.

3: Repeat steps (1) to (3), using an amplitude $A_2=A_1+d_A$ for the bump. Compute $(\Delta\phi)_2$.

4: If $(\Delta\phi)_2-(\Delta\phi)_1$ is too large, repeat steps (1) to (4) reducing $d_A$.

5: Find a suitable bump amplitude $A_i=A_1+n_i d_A$ using Expression/Equation (27).

6: Repeat steps (1) to (3). Compute $(\Delta\phi)_i$.

7: If $\phi_i^{i+}$ is too far from the desired value, repeat step (5) updating the linear regression law (27).

The above description describes a model and processes to estimate drill bit velocity and orientation position—the tool face—while drilling directional wells. The processes only use surface measurements and sampled and delayed tool face orientation measurements. The approach relies on an observer combined with an update law of the static and kinematic friction factors used in a non-linear Coulomb friction model and an update for the estimation of the orientation based on the available measurements. Such an observer has been successfully used on synthetic data. Combining this observer with existing stick-slip mitigation feedback laws, derived were three procedures/processes that can be used to control the drill bit orientation. These procedures have been successfully used in simulation using a field validated torsional drill string simulator and demonstrate rapid, accurate and robust setting of tool face. This presents a new advance towards effective and efficient closed loop directional drilling control.

The three processes noted above can be implemented using a suitable data processing module that receives input from sensors coupled to the drilling equipment. The data processing module can also be coupled to the drilling equipment such that the input to the motor or motors of the drilling equipment can be controlled by the data processing module. The above processes and methods can then be implemented with the data processing module calculating the necessary values to arrive at the suitable inputs to the drilling equipment.

To better understand the present invention, the reader is directed to the listing of citations below. The contents of the citations in the list at the end of this description are hereby incorporated by reference herein in their entirety.

C. Germay, V. D. (325(1-2):362-381). Multiple mode analysis of the self-excited vibrations of rotary drilling systems. Journal of Sound and Vibration, 2009.

D. J. Runia, S. D. (2013). A brief history of the Shell "Soft Torque Rotary System" and some recent case studies. SPE/IADC Drilling Conference. Society of Petroleum Engineers.

D. Stroud, M. R. (2003). Development of the industry's slimhole point-the-bit rotary steerable system. SPE Annual Technical Conference and Exhibition. Society of Petroleum Engineers.

F. Di Meglio, P.-O. L. (2018). Robust output feedback stabilization of an ODE-PDE-ODE interconnection. Automatica (submitted).

G. W. Halsey, A. K. (1988). Torque Feedback Used to Cure Slip-Stick Motion. SPE Annual Technical Conference and Exhibition (pp. 277-282). Society of Petroleum Engineers.

H. Mounier, J. R. (1998). Tracking control of a vibrating string with an interior mass viewed as delay system. ESAIM: Control, Optimisation and Calculus of Variations, 3:315-321.

I. N. de Almeida Jr, P. D. (2015). A review of telemetry data transmission in unconventional petroleum environments focused on information density and reliability. Journal of Software Engineering and Applications, 8(09):455.

J. Clegg, C. M. (2019). paradigm in rotary steerable drilling-market demands drive a new solution. SPE/IADC International Drilling Conference and Exhibition. Society of Petroleum Engineers.

J. F. Inyang, I. J. (2017). Directional drilling attitude control with input disturbances and feedback delay. IFAC-PapersOnLine, 50(1):1409-1414.

J. K. Wilson, G. H. (2015). Investigating the bene is of induced vibrations in unconventional horizontals via non-linear drill string dynamics modeling. SPE/IADC Drilling Conference and Exhibition. Society of Petroleum Engineers.

Jacobs, T. (2015). Automated drilling technologies showing promise. Journal of Petroleum Technology, 67(06):50-55.

K. J. Astrom and R. Murray. (2010). Feedback systems: an introduction for scientists and engineers. Princeton university press.

Kyllingstad, A., & Nessjoen, P. (2009). A New Stick-Slip Prevention System. Proceedings of SPE/IADC Drilling Conference and Exhibition, (pp. 17-19).

Kyllingstad., A. (2017). A Comparison of Stick-Slip Mitigation Tools. SPE/IADC Drilling Conference and Exhibition, Society of Petroleum Engineers.

L. W. Ledgerwood III, R. W. (2016). The e ect of bit type on reactive torque and consequent tool-face-control anomalies. SPE Drilling & Completion, 31(02):95-105.

LeVeque, R. J. (2002). Finite volume methods for hyperbolic problems. Cambridge University Press.

M C Sheppard, C. W. (1987). Designing Well Paths To Reduce Drag and Torque. SPE Drilling Engineering, 2(04):344-350.

M. Fliess, J. L. (1995). Flatness and defect of non-linear systems: introductory theory and examples. International journal of control, 61(6):1327-1361.

P. Weijermans, J. R. (2001). Drilling with rotary steerable system reduces wellbore tortuosity. SPE/IADC drilling conference. Society of Petroleum Engineers.

S. Schaaf, C. M. (2000). Point-the-bit rotary steerable system: Theory and field results. SPE Annaul Technical Conference and Exhibition. Society of Petroleum Engineers.

S.Dwars. (2015). Recent Advances in Soft Torque Rotary Systems. Proceedings of 2015 SPE/IADC Drilling Conference, (pp. 17-19).

U. J. Aarsnes, R. J. (2018). Torsional vibrations with bit off bottom: Modeling, characterization and field data validation. Journal of Petroleum Science and Engineering, 163: 712-721.

U. J. F Aarsnes, F. D. (2018). Avoiding stick slip vibrations in drilling through startup trajectory design. Journal of Process Control, 70:24-35.

U. J. F. Aarsnes and N. van de Wouw. (444(March):127-151). Axial and torsional self-excited vibrations of a distributed drill-string. Journal of Sound and Vibration, 2019.

U. J. F. Aarsnes and O. M. Aamo. (360:239-259). Linear stability analysis of self-excited vibrations in drilling using an infinite dimensional model. Journal of Sound and Vibration, 2016.

U. J. F. Aarsnes, F. M. (2018). Benchmarking of Industrial Stick-Slip Mitigation Controllers. IFAC Workshop on Automatic Control in 0 shore Oil and Gas Production.

U. J. F. Aarsnes, J. A. (2019). Estimating friction factors while drilling. Journal of Petroleum Science and Engineering.

It should be clear that the various aspects of the present invention may be implemented as software modules in an overall software system. As such, the present invention may thus take the form of computer executable instructions that, when executed, implements various software modules with predefined functions.

The embodiments of the invention may be executed by a computer processor or similar device programmed in the manner of method steps, or may be executed by an electronic system which is provided with means for executing these steps. Similarly, an electronic memory means such as computer diskettes, CD-ROMs, Random Access Memory (RAM), Read Only Memory (ROM) or similar computer software storage media known in the art, may be programmed to execute such method steps. As well, electronic signals representing these method steps may also be transmitted via a communication network.

Embodiments of the invention may be implemented in any conventional computer programming language. For example, preferred embodiments may be implemented in a procedural programming language (e.g., "C" or "Go") or an object-oriented language (e.g., "C++", "java", "PHP", "PYTHON" or "C#"). Alternative embodiments of the invention may be implemented as pre-programmed hardware elements, other related components, or as a combination of hardware and software components.

Embodiments can be implemented as a computer program product for use with a computer system. Such implementations may include a series of computer instructions fixed either on a tangible medium, such as a computer readable medium (e.g., a diskette, CD-ROM, ROM, or fixed disk) or transmittable to a computer system, via a modem or other interface device, such as a communications adapter connected to a network over a medium. The medium may be either a tangible medium (e.g., optical or electrical communications lines) or a medium implemented with wireless techniques (e.g., microwave, infrared or other transmission techniques). The series of computer instructions embodies all or part of the functionality previously described herein. Those skilled in the art should appreciate that such computer instructions can be written in a number of programming languages for use with many computer architectures or operating systems. Furthermore, such instructions may be stored in any memory device, such as semiconductor, magnetic, optical or other memory devices, and may be transmitted using any communications technology, such as optical, infrared, microwave, or other transmission technologies. It is expected that such a computer program product may be distributed as a removable medium with accompanying printed or electronic documentation (e.g., shrink-wrapped software), preloaded with a computer system (e.g., on system ROM or fixed disk), or distributed from a server over a network (e.g., the Internet or World Wide Web). Of course, some embodiments of the invention may be implemented as a combination of both software (e.g., a computer program product) and hardware. Still other embodiments of the invention may be implemented as entirely hardware, or entirely software (e.g., a computer program product).

A person understanding this invention may now conceive of alternative structures and embodiments or variations of the above all of which are intended to fall within the scope of the invention as defined in the claims that follow.

What is claimed is:

1. A method for controlling an orientation of a drilling rig tool face that is part of a drilling rig, the method comprising:

a) stabilizing a velocity of a borehole assembly of said drilling rig to a velocity reference;

b) prior to a motor of top drive reaching a release torque that causes motion to said tool face, increasing an input to said top drive to thereby cause an increase in torque in said motor, wherein an increase in said input is of a specified value;

c) determining an initial estimated difference in orientation of said tool face, said initial estimated difference resulting from said increase in torque;

d) repeating steps a) and b) with said input having a value equal to an immediately preceding input value and said specified value;

e) determining a second estimated difference in orientation of said tool face due to said input equaling said immediately preceding input value and said specified value;

f) determining a desired input value to produce said desired orientation based at least on said initial estimated difference and said second estimated difference and said specified value;

g) repeating step a) and applying said desired input value determined in step f) to produce said desired orientation of said tool face.

2. The method according to claim 1, wherein, in the event a difference between said initial estimated difference and said second estimated difference is larger than desired, said method further comprises decreasing said specified value and repeating steps a) through g).

3. The method according to claim 1, wherein in the event a difference between an orientation of said tool face and said desired orientation is larger than a threshold, said method further comprises decreasing a commanded input velocity trajectory and repeating steps a) through g).

4. The method according to claim 1, wherein in the event a difference between an orientation of said tool face and said desired orientation is larger than a threshold, said method further comprises adjusting said specified value and repeating steps a) through g).

* * * * *